United States Patent [19]

Neuman

[11] 4,054,394

[45] Oct. 18, 1977

[54] QUICK RELEASE LOCKING DEVICE

[75] Inventor: Don E. Neuman, Anderson, Ind.

[73] Assignee: Dovey Manufacturing Company, Anderson, Ind.

[21] Appl. No.: 746,303

[22] Filed: Dec. 1, 1976

[51] Int. Cl.[2] ..... B26D 7/26

[52] U.S. Cl. ..... 403/344; 403/374; 24/249 R; 83/665

[58] Field of Search ..... 83/665, 664, 504, 507, 83/498, 698; 403/344, 374, 350, 409; 24/249 R, 134 R; 279/1 TE, 6, 1 Q; 93/58.2 R, 58.2 F, 58 R

[56] References Cited

U.S. PATENT DOCUMENTS

| | | | |
|---|---|---|---|
| 945,106 | 1/1910 | Moodey | 403/344 |
| 2,491,976 | 12/1949 | Hauser | 83/665 X |
| 3,246,555 | 4/1966 | Finlay | 83/665 |
| 3,837,265 | 9/1974 | Tokuno | 83/665 X |
| 3,850,069 | 11/1974 | Saunders | 83/665 |
| 3,894,462 | 7/1975 | Lundtoft | 83/665 |

*Primary Examiner*—James F. Coan

*Attorney, Agent, or Firm*—Meyer, Tilberry & Body

[57] ABSTRACT

A quick release locking device is provided for adjustably securing a circular tool carrier head about a shaft of a rotary die cutting mechanism in which a cylindrical cam has the camming face of the cylinder undercut and filled with a deformable non-compressible plastic substance to increase the resiliency of the camming face.

9 Claims, 7 Drawing Figures

FIG. 4
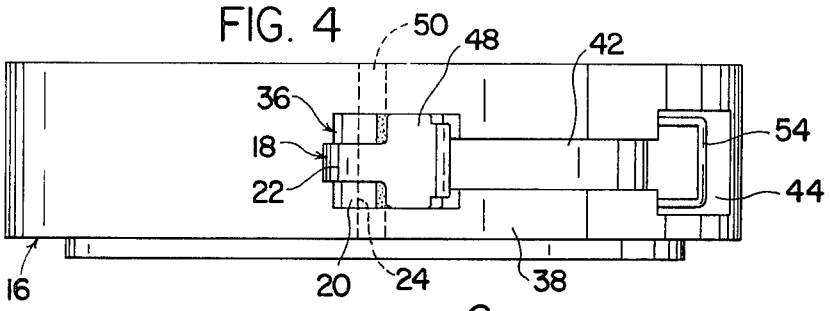
FIG. 5
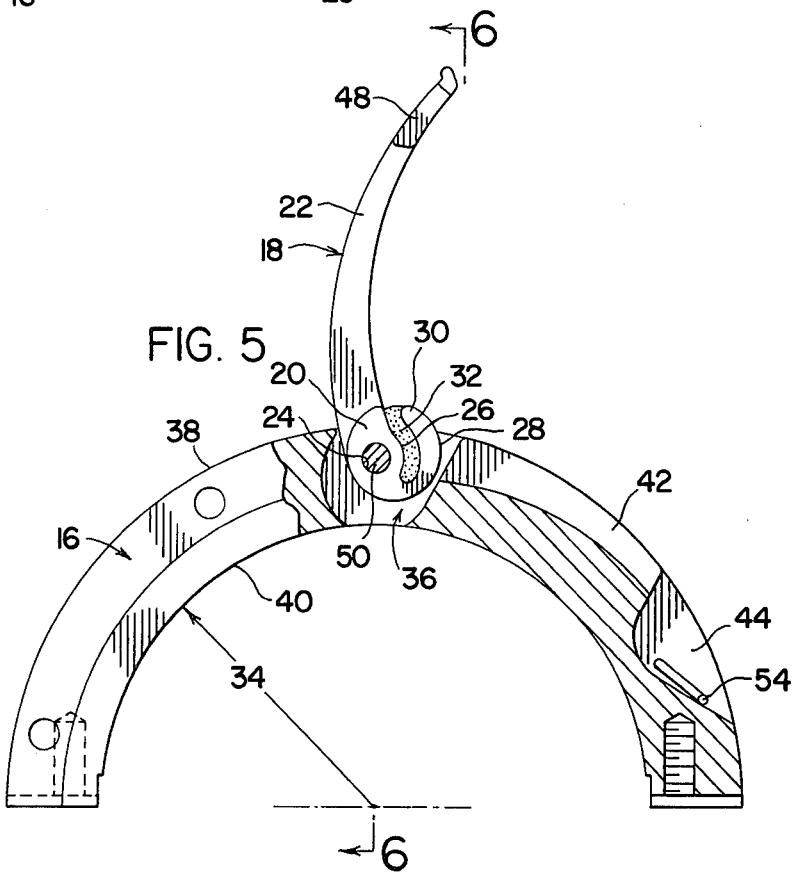
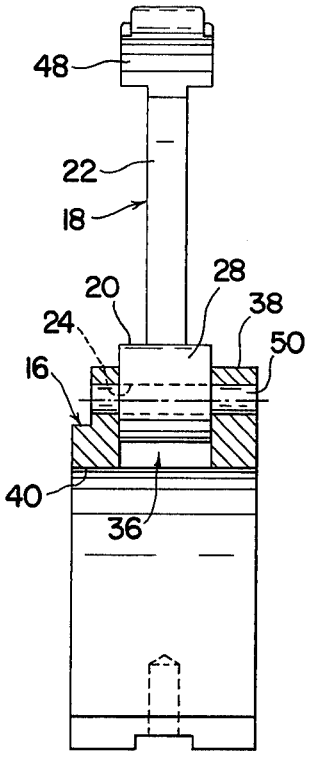
FIG. 6
FIG. 7
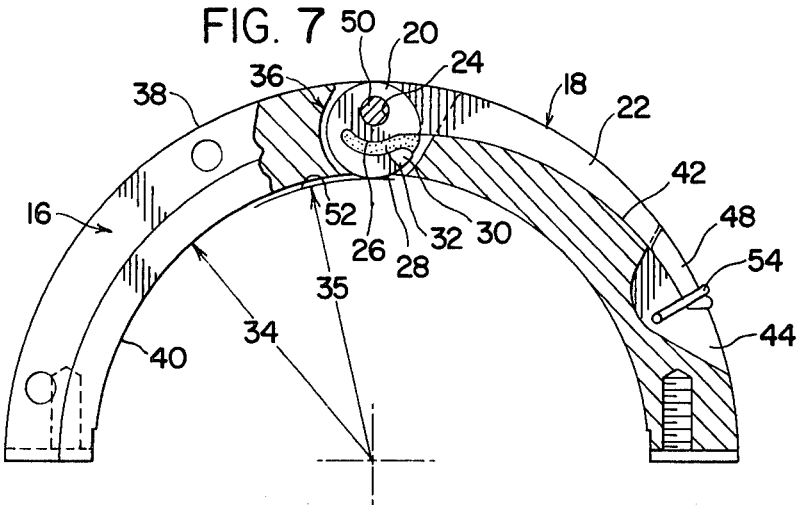

QUICK RELEASE LOCKING DEVICE

This invention relates in particular to the rotary die cutting art and, especially, to the art of rotary die cutting of corrugated board. However, it will be recognized upon a reading of this disclosure that the invention is equally applicable to mechnaisms in other arts wherein the principles of this invention may be utilized in various environments. An example of a rotary die cutting mechanism is a so called slit-score machine which, as the name implies, both slits and scores corrugated board for use in box blank manufacturing. In a typical mechanism, one or more shafts are horizontally mounted in a suitable frame, and a plurality of circular tool carrier heads are mounted about these shafts to carry rotary cutting or forming tools for various purposes. In a slit-score machine, a pair of vertically aligned, horizontally parallel shafts have mounted on them mating cutting andor forming tools, whereby a corrugated board blank may be passed between these tools to have appropriate slitting and/or scoring operations performed on the board.

In order to quickly set up for a particular operation, it is important that the heads carrying the cutting or forming tools and anvils be easily slidably adjusted on the supporting shafts from job to job. For this purpose, the circular heads are made in two pieces and adapted to be secured together by cap screws, bolts or other standard fastening devices. Originally, the heads were positioned on the shaft for a particular operation and then the two halves were fastened together in gripping relationship about the shaft. Thereafter, if the tools were to be repositioned for a different size board or different type of board, the cap screws had to be loosened and the heads shifted to new locations on the shaft. This was a very time consuming set up operation and, to shorten set up time, quick release mechanisms are known to have been used in lieu of loosening and re-tightening cap screws.

The present invention is a quick release mechanism to permit rapid adjustment of heads on their respective shafts which is believed to be an improvement over all known prior art quick release mechanisms.

It is therefore an object of this invention to provide adjustable locking devices for rotary heads which utilize fewer parts than prior art adjustable locking devices.

It is another object of this invention to provide an adjustable locking device which has greater resiliency thanprior art locking devices.

It is still another object of this invention to provide a locking device having improved wear characteristics over prior art devices.

It is yet another object of this invention to provide an adjustable locking device which is less expensive to manufacture, quicker to install and provides longer useful life.

It is also another object of this invention to provide adjustable locking devices for rotary heads which provide more positive engagement between the rotary heads and the shafts upon which the heads are mounted.

It is still yet another object of this invention to provide adjustable locking devices for heads which are quickly released to enable fast adjustment of the heads on their respective shafts and quickly re-engaged in their relocated positions.

With the foregoing and other objects and features of the invention which will become evident from a reading of this specification, the invention consists of certain novel features of design and arrangement as illustrated in the accompanying drawings, and particularly pointed out in the appended claims, it being understood that various changes in the form, proportion, size and minor details of the invention may be made without departing from the spirit, or sacrificing any of the advantages of the invention.

For the purpose of facilitating an understanding of the invention, there is illustrated in the accompanying drawings a preferred embodiment thereof, from an inspection of which when considered in connection with the following description, the invention, its mode of construction, assembly and application and many of its advantages, will be readily understood.

Reference is now made to the drawings in which the same characters of reference are employed to indicate corresponding or similar parts throughout the several Figures of the drawings, in which:

FIG. 4 is a side elevational view of the preferred embodiment shown in FIG. 3, but revolved 90°;

FIG. 5 is a front fragmentary elevational view partially in section showing the invention in the released position;

FIG. 6 is a side fragmentary elevational view partially in section of the invention taken along the line 6—6 of FIG. 5; and, FIG. 7 is a front fragmentary elevational view partially in section showing the invention in the locked position.

Figure 1:
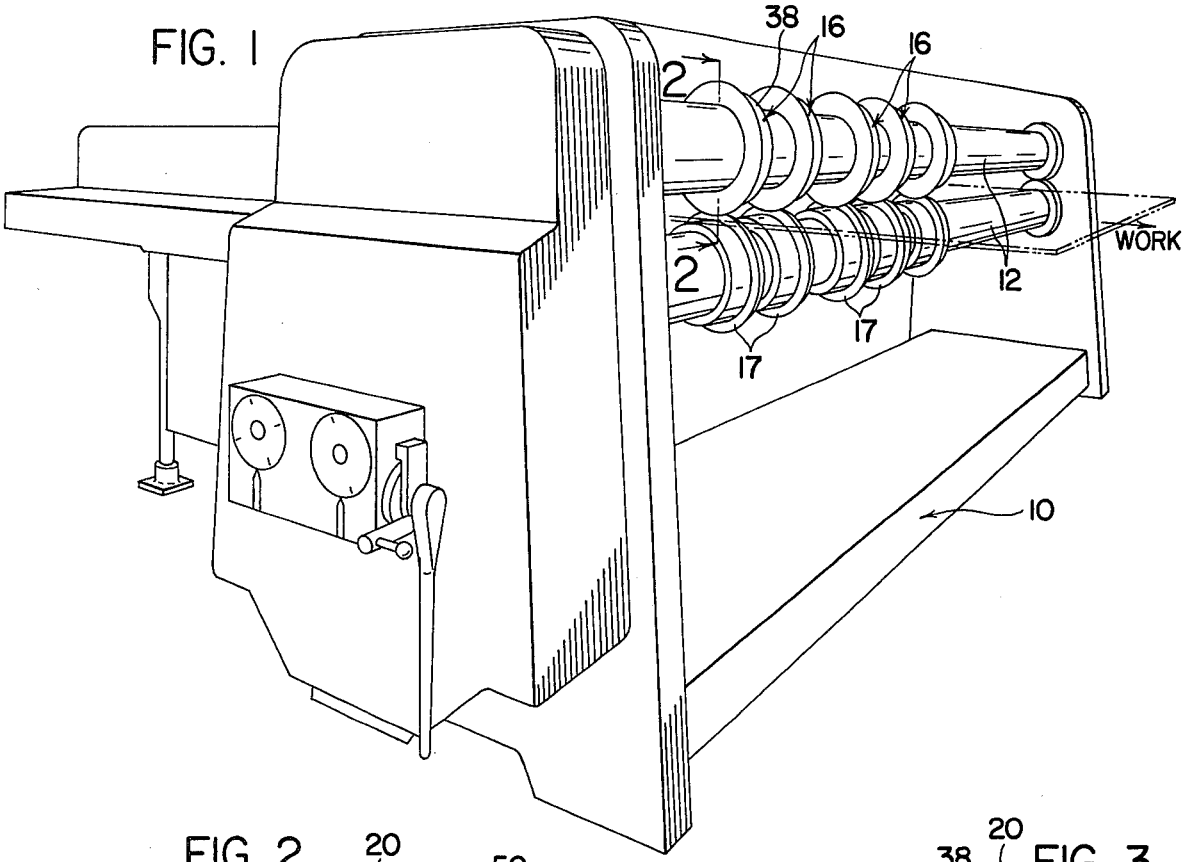
FIG. 1 is a perspective view of a rotary scoring and cutting machine of the type which may be benefited by the subject invention.

Referring now to the drawings in greater specificity, FIG. 1 shows a conventional rotary die cutting machine 10 wherein are mounted a pair of parallel horizontal shafts 12. Mounted on shafts 12 are a plurality of tool cutting or forming anvil heads 16 and 17, respectively (hereinafter referred to as "heads"), which are adapted for processing various corrugated paperboard blanks. As shown, there are five matching sets of rotary heads to perform particular cutting, slitting or scoring operations on corrugated cardboard. Upon completion of a particular run of corrugated board, it may be necessary to realign the heads on the shafts to different positions. The inside diameters of the heads are just sufficiently greater than the outside diameters of the shafts 12 that they may freely slide laterally along their respective shafts.

Figure 2:
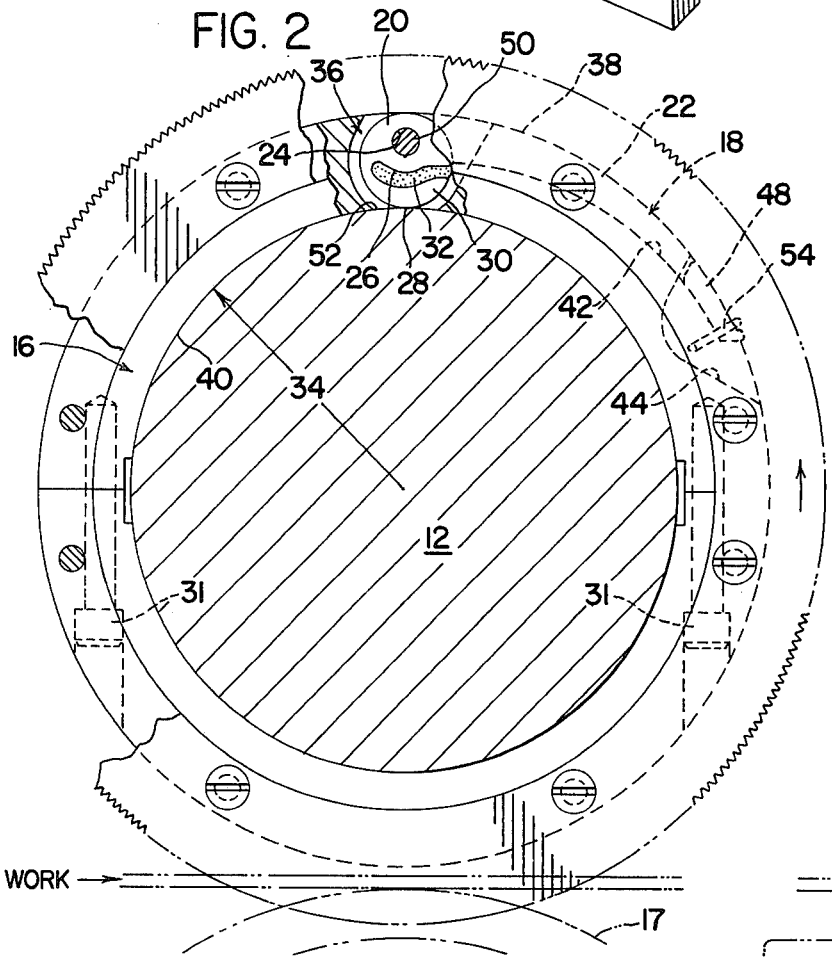
FIG. 2 is a front elevational view of a preferred embodiment of the invention shown mounted in a circular head taken along the line 2—2 of FIG. 1.

When accurately re-positioned, the heads are then locked in place by the adjustable locking mechanism which is illustrated mounted on a head 16 as shown in FIG. 2. This locking mechanism 18 comprises a cylindrical barrel 20, shown in end view in FIG. 2, to which is attached a lever arm 22 arcuately shaped to conform to the contour of the circular head 16. A hole 24 extends through the barrel 20 eccentric to, and longitudinal with, the longitudinal axis of the barrel 20. A slot 26 longitudinally undercuts the cam face 28 of the barrle 20 to provide a resilient appendage 30. A resilient deformable,non-compressible plastic 32 is bonded to the inner faces of slot 26 to reinforce the appendage 30.

Figure 3:
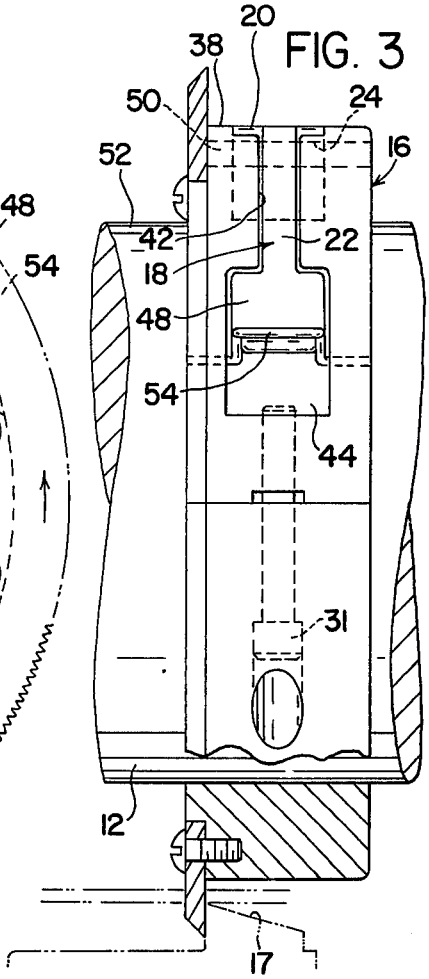
FIG. 3 is a side elevational view of the preferred embodiment of the invention shown in FIG. 2.

Referring now to FIGS. 5–7, there is shown one-half of a circular head 16, it being understood that the other half is secured to the first mentioned half by conventional threaded fastener means 31, such as shown in FIGS. 2 and 3. The radius of curvature 34 of head 16 is sufficiently greater than the radius of curvature 35 of the shaft 12 (FIG. 7) to provide ease of sliding the head laterally along the surface of the shaft for quick readjustment. An aperture 36 is formed in the head 16 extending through from the head upper surface 38 to the lower surface 40. A groove 42, best shown in FIG. 5, is also formed in the upper surface 38 of head 16 terminating at one end in aperture 36 and at the opposite end in a widened groove portion 44. The lever arm 22 is secured at one end to the cam barrel 20 counterclockwise to the left of cam barrel slot 26, and is adapted to be received within groove 42. The end of lever arm 22 remote from the cam barrel is provided with a tool or finger grip flange 48 which is receivable in widened groove 44. A pin 50 pivotally secures cam barrel 20 in aperture 36 of head 16, and a detent, such as a spring clip 54, may be employed to hold the lever 22 and flange 48 in place in groove 42.

Inasmuch as hole 24 is eccentric to the axis of cam barrel 20, rotation of lever arm 22 clockwise, as shown in FIG. 7, shifts camming appendage 30 and cam face 28 to a position beneath the lower extremity of aperture 36 thereby making pressure contact with the surface 52 of shaft 12. As the pressure builds between cam face 28 and the surface 52 of shaft 12, the resilient plastic 32 is deformed sufficiently to permit appendage 30 to yield proportionately to the pressure developed between cam face 28 and shaft surface 52. To shift a tool head 16 or anvil head 17 to a new location lever 22 is rotated counterclockwise, as shown in FIG. 5, wherein the head is free to be shifted horizontally on the shaft to a new location. Lever 22 is then rotated clockwise into groove 42 to lock the anvil in its new position wherein detent 54 is slipped over the lever arm flange 48 to secure the lever 22 in groove 42.

It is believed that the invention, its mode of fabrication and assembly, and its advantages will be understood from the foregoing description, and it is further believed that, while a preferred embodiment of the invention has been shown and described for illustrative purposes, the structural details are nevertheless capable of variation within the intent and scope of the invention as defined in the appended claims. It should be further stated that whereas this invention is shown in its preferred embodiment with relation to rotary die cutting machinery, it is apparent that this adjustable locking mechanism is equally applicable to any similar ring type member which must be quickly clamped and unclamped on a shaft for fast adjustment.

What is claimed is:

1. A circular member locking device for use on a rotary shaft in which said circular member includes an aperture to receive said locking device therein comprising: a cylindrical cam; a hole eccentrically located through said cam and parallel to its longitudinal axis; a longitudinal slot in said cylindrical cam remote from said hole to form a resilient camming appendage; pin means receivable in said hole to rotatably mount said cylindrical cam in said aperture; and cam appendage biasing means interposed in said slot whereby when said circular member is mounted about said shaft, said cam appendage may be rotated into locking engagement with said shaft.

2. The device of claim 1, wherein said biasing means comprises a deformable, non-compressible plastic substance bonded in said slot.

3. The device of claim 1, including means to rotate said cam appendage into locking engagement with said shaft.

4. The device of claim 1, including lever means secured to said cylindrical cam to rotate said cam appendage into locking engagement with said shaft.

5. The device of claim 4, including means to secure said lever against counter-rotation after said cam appendage has been rotated into locking engagement with said shaft.

6. A rotary tool carrier head for quick, adjustable mounting on a rotary shaft comprising: outside and inside peripheral surfaces on said tool carrier head and with the diameter of said inside peripheral surface being slidably in excess of the outside diameter of said shaft, said tool carrier head being adapted to be mountable about said shaft; an aperture in said tool carrier head extending radially from its outside to its inside peripheral surfaces; an arcuate groove in the outside peripheral surface of said tool carrier head terminating at one end in said aperture; a self-compensating locking member including a cylindrical cam having a camming surface adapted to be received in said aperture; a lever secured to said cylindrical cam adapted to be received within said arcuate groove; means to eccentrically mount said cam for pivotal movement within said aperture; a slot in said cam undercutting said camming surface, and resilient means interposed in said slot whereby, when said tool carrier head is mounted about said shaft, rotation of said lever into said groove will urge said camming surface into biased pressure engagement with the outside surface of said shaft.

7. The device of claim 6, wherein said means to eccentrically mount said cam comprises a hole formed therethrough eccentric and parallel to the longitudinal axis of said cylindrical cam; pin means receivable in said eccentric hole to rotatably mount said cam in said aperture.

8. The device of claim 6, wherein said resilient means comprises a deformable, non-compressible plastic substance bonded in said slot.

9. The device of claim 6, including detent means to secure said lever in said groove.

* * * * *